US009080125B2

(12) United States Patent
Deshimaru

(10) Patent No.: US 9,080,125 B2
(45) Date of Patent: Jul. 14, 2015

(54) LUBRICATING OIL COMPOSITION

(75) Inventor: Junichi Deshimaru, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 280 days.

(21) Appl. No.: 13/519,920

(22) PCT Filed: Nov. 12, 2010

(86) PCT No.: PCT/JP2010/070204

§ 371 (c)(1),
(2), (4) Date: Jun. 29, 2012

(87) PCT Pub. No.: WO2011/080970

PCT Pub. Date: Jul. 7, 2011

(65) Prior Publication Data

US 2012/0277134 A1 Nov. 1, 2012

(30) Foreign Application Priority Data

Dec. 29, 2009 (JP) ..... 2009-299078

(51) Int. Cl.
*C10M 141/10* (2006.01)
*C10M 137/04* (2006.01)

(52) U.S. Cl.
CPC ..... *C10M 141/10* (2013.01); *C10M 2203/1006* (2013.01); *C10M 2219/00* (2013.01); *C10M 2219/083* (2013.01); *C10M 2219/106* (2013.01); *C10M 2223/00* (2013.01); *C10M 2223/04* (2013.01); *C10M 2223/041* (2013.01); *C10M 2223/043* (2013.01); *C10M 2223/045* (2013.01); *C10M 2223/049* (2013.01); *C10N 2220/022* (2013.01); *C10N 2230/06* (2013.01); *C10N 2230/42* (2013.01); *C10N 2230/43* (2013.01); *C10N 2230/70* (2013.01); *C10N 2240/04* (2013.01); *C10N 2240/042* (2013.01); *C10N 2240/045* (2013.01); *C10N 2240/201* (2013.01)

(58) Field of Classification Search
USPC ..... 508/272, 433, 441, 442
See application file for complete search history.

(56) References Cited

U.S. PATENT DOCUMENTS

| | | | | |
|---|---|---|---|---|
| 2003/0158050 | A1* | 8/2003 | Kawasaki et al. | 508/272 |
| 2004/0209786 | A1 | 10/2004 | Sagawa et al. | |
| 2008/0058233 | A1 | 3/2008 | Sagawa et al. | |
| 2008/0194442 | A1 | 8/2008 | Watts et al. | |
| 2009/0215657 | A1* | 8/2009 | Ripple | 508/186 |
| 2010/0144571 | A1* | 6/2010 | Shirahama et al. | 508/465 |
| 2011/0092402 | A1 | 4/2011 | Sagawa et al. | |

FOREIGN PATENT DOCUMENTS

| | | | |
|---|---|---|---|
| CN | 101245279 | A | 8/2008 |
| CN | 101517054 | A | 8/2009 |
| EP | 1 405 897 | A1 | 4/2004 |
| EP | 1 964 911 | A2 | 9/2008 |
| EP | 1 964 911 | A3 | 9/2008 |
| JP | 2 32195 | | 2/1990 |
| JP | 9 235581 | | 9/1997 |
| JP | 10 8081 | | 1/1998 |
| JP | 2003 171684 | | 6/2003 |
| JP | 3970354 | B2 | 9/2007 |
| JP | 2008 195942 | | 8/2008 |
| WO | 02 097017 | | 12/2002 |
| WO | WO 2007/005423 | A2 | 1/2007 |
| WO | WO 2007/005423 | A3 | 1/2007 |
| WO | WO 2007001000 | A1 * | 1/2007 |
| WO | 2008 038571 | | 4/2008 |

OTHER PUBLICATIONS

U.S. Appl. No. 13/517,385, filed Jun. 20, 2012, Tsubouchi.
U.S. Appl. No. 13/519,792, filed Jun. 28, 2012, Tsubouchi.
Extended European Search Report Issued Jul. 4, 2013 in Patent Application No. 10840829.5.
International Search Report Issued Feb. 8, 2011 in PCT/JP10/70204 filed Nov. 12, 2010.
Chinese Office Action issued Jul. 30, 2013, in China Patent application 201080060459.0 (with English translation).

* cited by examiner

*Primary Examiner* — James Goloboy
(74) *Attorney, Agent, or Firm* — Oblon, McClelland, Maier & Neustadt, L.L.P.

(57) ABSTRACT

A lubricating oil composition contains: at least one lubricating base oil selected from the group consisting of a mineral lubricating base oil and a synthetic lubricating base oil; (a) a neutral phosphorus compound; (b) at least one acid phosphorus compound selected from the group consisting of a specific acid phosphate amine salt and a specific acid phosphite; and (c) a sulfur compound.

17 Claims, No Drawings

LUBRICATING OIL COMPOSITION

TECHNICAL FIELD

The present invention relates to a lubricating oil composition. In particular, the present invention relates to a lubricating oil composition used for a motor, a battery, an inverter, an engine, an electric cell or the like in a hybrid vehicle or an electric vehicle.

BACKGROUND ART

Recently, $CO_2$ reduction has been strongly required for global environmental protection, so that technologies to fuel-efficient have been vigorously developed in the automotive field. Such technologies to fuel-efficient are mainly related to hybrid vehicles and electric vehicles, which will be rapidly becoming popular in the future. Hybrid vehicles and electric vehicles include an electric motor and a generator and are partly or entirely driven by the electric motor. An oil-cooling type can be employed to cool the electric motor in hybrid vehicles or electric vehicles. In this case, typical automatic transmission fluid (ATF) or continuously variable transmission fluid (CVTF) is usually usable as a lubricating oil composition. Such a lubricating oil composition is blended with a variety of additives so that the lubricating oil composition is provided with properties for controlling wet clutch friction and for suppressing wear between metal-metal (i.e., resistance to wear between metals), and has a volume resistivity of approximately $10^7$ Ωm. The volume resistivity of the lubricating oil composition is lowered as the lubricating oil is deteriorated. In view of the above, the lubricating oil composition usable in hybrid vehicles or electric vehicles is required not only to be excellent in resistance to wear between metal-metal but also to be excellent in electrical insulation properties for reliably ensuring the insulation of the electric motor for a long time.

Accordingly, there has been suggested a lubricating oil composition containing a lubricating base oil, and a phosphorus compound selected from the group consisting of (A) a zinc dithiophosphate containing a hydrocarbon group, (B) a triaryl phosphate, (C) a triaryl thiophosphate and mixtures thereof, the lubricating oil composition exhibiting a volume resistivity of $1\times10^8$ Ωm or more at 80 degrees C. (see, for instance, Patent Literature 1). There has also been suggested a method of supplying a lubricating oil composition containing (a) a base oil, (b) an oil-soluble phosphorus-containing substance and (c) an anticorrosive agent to a transmission.

CITATION LIST

Patent Literature(s)

Patent Literature 1: WO2002/097017
Patent Literature 2: JP-A-2008-195942

SUMMARY OF THE INVENTION

Problem(s) to Be Solved by the Invention

Even the lubricating oil composition disclosed in Patent Literature 1 is not sufficient in terms of electrical insulation properties because the volume resistivity thereof is in a range from $2.4\times10^8$ to $4.3\times10^9$ Ωm. Likewise, even the lubricating oil composition disclosed in Patent Literature 2 is not sufficient in electrical insulation properties.

Accordingly, an object of the invention is to provide a lubricating oil composition that is excellent in resistance to wear between metal-metal and in electrical insulation properties.

Means for Solving the Problems

In order to solve the above problems, the following lubricating oil composition is provided according to the invention.

According to an aspect of the invention, a lubricating oil composition contains: at least one lubricating base oil selected from the group consisting of a mineral lubricating base oil and a synthetic lubricating base oil; (a) a neutral phosphorus compound; (b) at least one acid phosphorus compound selected from the group consisting of an acid phosphate amine salt represented by a formula (1) below and an acid phosphite represented by a formula (2) below; and (c) a sulfur compound.

Formula 1

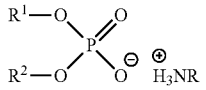

(1)

Formula 2

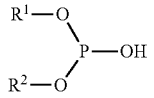

(2)

In the formulae (1) and (2), $R^1$ and $R^2$ each represent hydrogen or a hydrocarbon group having 8 to 30 carbon atoms, at least one of $R^1$ and $R^2$ being the hydrocarbon group having 8 to 30 carbon atoms, the hydrocarbon group being at least one hydrocarbon group selected from the group consisting of an alkyl group, an alkenyl group, an aryl group, an alkylaryl group and an arylalkyl group.

In the above aspect, it is preferable that a content of the component (a) is in a range from 100 ppm by mass to 2000 ppm by mass in terms of a phosphorus amount in a total amount of the composition. It is preferable that a content of the component (b) is in a range from 50 ppm by mass to 400 ppm by mass in terms of the phosphorus amount in the total amount of the composition. It is preferable that a content of the component (c) is in a range from 125 ppm by mass to 1000 ppm by mass in terms of a sulfur amount in the total amount of the composition.

In the above aspect, the lubricating oil composition is usable for cooling a device in a hybrid vehicle or an electric vehicle and for lubricating a gear.

In the above aspect, the device to be cooled using the lubricating oil composition is at least one of a motor, a battery, an inverter, an engine and an electric cell.

Effect(s) of the Invention

According to the invention, a lubricating oil composition excellent in resistance to wear between metal-metal and in electrical insulation properties can be provided.

DESCRIPTION OF EMBODIMENT(S)

According to an exemplary embodiment, a lubricating oil composition (hereinafter also referred to as a "composition")

contains at least one lubricating base oil selected from the group consisting of a mineral lubricating base oil and a synthetic lubricating base oil, (a) a neutral phosphorus compound, (b) at least one acid phosphorus compound selected from the group consisting of an acid phosphate amine salt represented by the formula (1) and an acid phosphite represented by the formula (2), and (c) a sulfur compound. The composition will be described below in detail.

Base Oil

The lubricating base oil (hereinafter also referred to simply as a "base oil") used in the composition may be a mineral lubricating base oil or a synthetic lubricating base oil. The lubricating base oil is not particularly limited in type, but may be suitably selected from mineral oils and synthetic oils that have been typically used as a base oil for a lubricating oil for an automobile transmission.

Examples of the mineral lubricating base oil are a paraffin group mineral oil, an intermediate group mineral oil and a naphthene group mineral oil. Examples of the synthetic lubricating base oil are polybutene, polyolefin (e.g., an alpha-olefin homopolymer or an alpha-olefin copolymer such as an ethylene-alpha-olefin copolymer), various esters (e.g., polyol ester, dibasic ester and phosphate), various ethers (e.g., polyphenylether), polyglycol, alkylbenzene, and alkyl naphthalene.

In the exemplary embodiment, one of the above mineral lubricating base oils may be singularly used or a combination of two or more thereof may be used as the base oil. In addition, one of the above synthetic lubricating base oils may be singularly used or a combination of two or more thereof may be used. Further, at least one of the above mineral lubricating base oils and at least one of the above synthetic lubricating base oils may be used in combination.

Although the viscosity of the base oil is subject to no specific limitation and varies depending on the usage of the lubricating oil composition, the kinematic viscosity thereof at 100 degrees C. is preferably in a range from 3 $mm^2/s$ to 8 $mm^2/s$. When the kinematic viscosity at 100 degrees C. is 3 $mm^2/s$ or more, evaporation loss is reduced. When the kinematic viscosity at 100 degrees C. is 8 $mm^2/s$ or less, power loss due to viscosity resistance is reduced, thereby improving fuel efficiency.

As the base oil, oil whose % CA measured by a ring analysis is 3.0 or less and whose sulfur content is 50 ppm by mass or less is favorably usable. The % CA measured by a ring analysis means a proportion (percentage) of an aromatic content calculated by a ring analysis (the n-d-M method). The sulfur content is a value measured in accordance with a method defined in JIS (Japanese Industrial Standard) K2541.

The lubricating base oil whose % CA is 3.0 or less and whose sulfur content is 50 ppm by mass or less exhibits favorable oxidation stability. Such a lubricating base oil can restrain an increase in acid number and a generation of sludge, and provides a lubricating oil composition that is less corrosive to metal. The % CA is more preferably 1.0 or less, much more preferably 0.5 or less. The sulfur content is more preferably 30 ppm by mass or less.

In addition, the viscosity index of the base oil is preferably 70 or more, more preferably 100 or more, much more preferably 120 or more. As long as the viscosity index of the base oil is equal to or more than the above upper limit, a change in the viscosity of the base oil due to a change in temperature is reduced and thus fuel efficiency can be improved even at a low temperature.

Component (a)

The component (a) used in the exemplary embodiment is a neutral phosphorus compound. The neutral phosphorus compound can be exemplified by compounds represented by the following formulae (3) and (4).

Formula 3

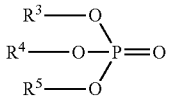

(3)

Formula 4

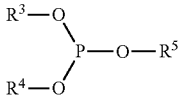

(4)

In the formulae (3) and (4), $R^3$, $R^4$ and $R^5$ each represent a hydrocarbon group. Specifically, $R^3$, $R^4$ and $R^5$ each represent an aryl group having 6 to 30 carbon atoms, an alkyl group having 1 to 30 carbon atoms, or an alkenyl group having 2 to 30 carbon atoms. $R^3$, $R^4$ and $R^5$ may be mutually the same or different.

Examples of the neutral phosphorus compound are: aromatic neutral phosphates such as a tricresyl phosphate, a triphenyl phosphate, a trixylenyl phosphate, a tricresyl phenyl phosphate, a tricresyl thiophosphate and a triphenyl thiophosphate; aliphatic neutral phosphates such as a tributyl phosphate, a tri-2-ethylhexyl phosphate, a tributoxy phosphate and a tributyl thiophosphate; aromatic neutral phosphites such as a triphenyl phosphite, a tricresyl phosphite, a trisnonyl phenyl phosphite, a diphenylmono-2-ethylhexyl phosphite, a diphenylmono tridecyl phosphite, tricresyl thiophosphite and a triphenyl thiophosphite; and aliphatic neutral phosphites such as a tributyl phosphite, a trioctyl phosphite, a trisdecyl phosphite, a tristridecyl phosphite, a trioleyl phosphite, a tributyl thiophosphite and a tryoctyl thiophosphite. Among the above, in consideration of resistance to wear between metal-metal, aromatic neutral phosphates, aliphatic neutral phosphates and the like are preferably usable. One of the above neutral phosphorus compounds may be singularly used or a combination of two or more thereof may be used.

In consideration of solubility to the lubricating base oil, the content of the component (a) in the composition is preferably 2000 ppm by mass or less in terms of the phosphorus amount in the total amount of the composition, more preferably in a range from 100 ppm by mass to 2000 ppm by mass, particularly preferably in a range from 200 ppm by mass to 1000 ppm by mass. When the content of the component (a) is equal to or more than the above lower limit, the lubricating oil composition can exhibit improved resistance to wear between metal-metal. When the content of the component (a) exceeds the above upper limit, the solubility of the component (a) to the lubricating base oil may be lowered.

Component (b)

The component (b) used in the composition is at least one acid phosphorus compound selected from the group consisting of an acid phosphate amine salt represented by the following formula (1) and an acid phosphite represented by the following formula (2).

Formula 5

(1)

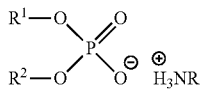

Formula 6

(2)

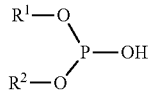

In the formulae (1) and (2), $R^1$ and $R^2$ each represent hydrogen or a hydrocarbon group having 8 to 30 carbon atoms. $R^1$ and $R^2$ may be mutually the same or different. Further, it is preferable that at least one of $R^1$ and $R^2$ is the hydrocarbon group having 8 to 30 carbon atoms and it is more preferable that both of them are the hydrocarbon groups having 8 to 30 carbon atoms. When the hydrocarbon group has less than 8 carbon atoms, the oxidation stability of the lubricating oil composition is lowered. When the hydrocarbon group has more than 30 carbon atoms, the lubricating oil composition may exhibit insufficient resistance to wear between metal-metal. Examples of the hydrocarbon group as $R^1$ and $R^2$ are an alkyl group, an alkenyl group, an aryl group, an alkylaryl group and an arylalkyl group.

Examples of the acid phosphate amine salt represented by the formula (1) are: aliphatic acid phosphate amine salts such as a di-2-ethylhexyl acid phosphate amine salt, a dilauryl acid phosphate amine salt and a dioleyl acid phosphate amine salt; aromatic acid phosphate amine salts such as a diphenyl acid phosphate amine salt and a dicresyl acid phosphate amine salt; and sulfur-containing acid phosphate amine salts such as a S-octyl thioethyl acid phosphate amine salt and a S-dodecyl thioethyl acid phosphate amine salt. One of the above acid phosphate amine salts may be singularly used or a combination of two or more thereof may be used.

Examples of the acid phosphite and amine salts thereof are: aliphatic acid phosphites such as a dibutyl hydrogen phosphite, a di-2-ethylhexyl hydrogen phosphite, a dilauryl hydrogen phosphite and a dioleyl hydrogen phosphite; aromatic acid phosphites such as a diphenyl hydrogen phosphite and a dicresyl hydrogen phosphite; and sulfur-containing acid phosphites such as a S-octylthioethyl hydrogen phosphite and a S-dodecylthioethyl hydrogen phosphite. Any one of the above acid phosphites may be contained in the composition as an amine salt thereof. One of the above acid phosphites and the amine salts thereof may be singularly used or a combination of two or more thereof may be used.

In consideration of the volume resistivity of the lubricating oil composition, the content of the component (b) in the composition is preferably 400 ppm by mass or less in terms of the phosphorus amount in the total amount of the composition, more preferably in a range from 50 ppm by mass to 400 ppm by mass, particularly preferably in a range from 50 ppm by mass to 250 ppm by mass. When the content of the component (b) is equal to or more than the above lower limit, the lubricating oil composition can exhibit improved resistance to wear between metal-metal. When the content of the component (b) exceeds the above upper limit, the lubrication oil composition may exhibit insufficient volume resistivity.

Component (c)

The component (c) used in the composition is a sulfur compound. The sulfur compound, which may be any one of well-known sulfur compounds, is exemplified by a thiadiazole compound, a polysulfide compound, a thiocarbamate compound, a sulfurized fat and oil compound and a sulfurized olefin compound. Among the above, in consideration of metal seizure resistance and resistance to wear between metal-metal, a thiadiazole compound and a polysulfide compound are preferable. One of the above sulfur compounds may be singularly used or a combination of two or more thereof may be used.

The thiadiazole compound, which may be any one of well-known thiadiazole compounds, is exemplified by a compound represented by the following formula (5).

Formula 7

(5)

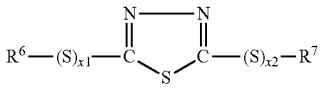

In the formula (5), $R^6$ and $R^7$ each represent an alkyl group having 1 to 30 carbon atoms, preferably 6 to 20 carbon atoms. The alkyl group may be linear or branched. $R^6$ and $R^7$ may be mutually the same or different. X1 and X2 each represent an integer of 1 to 3 as the number of sulfur atoms. The number of sulfur atoms is preferably 2. Among the thiadiazole compounds that can be represented by the formula (5), a 2,5-bis (1,1,3,3-tetramethylbutanedithio)-1,3,4-thiadiazole is particularly preferable.

The polysulfide compound, which may be any one of well-known polysulfide compounds, is exemplified by a compound represented by the following formula (6).

$$R^8—(S)_Y—R^9 \quad (6)$$

In the formula (6), $R^8$ and $R^9$ each represent an alkyl group having 1 to 20 carbon atoms, an aryl group having 3 to 20 carbon atoms, or an alkylaryl group having 7 to 20 carbon atoms. $R^8$ and $R^9$ may be mutually the same or different. Y represents an integer of 2 to 8 as the number of sulfur atoms. Examples of the groups represented by $R^8$ and $R^9$ are: aryl groups such as a phenyl group, a naphthyl group, a benzyl group, a tolyl group and a xyl group; and alkyl groups such as a methyl group, an ethyl group, a propyl group, a butyl group, a pentyl group, a hexyl group, a heptyl group, an octyl group, a nonyl group, a decyl group, a dodecyl group, a cyclohexyl group and a cyclooctyl group. The above groups may be linear or branched. One of the above groups may be singularly used or a combination of two or more thereof may be used. Among the polysulfide compounds that can be represented by the formula (6), a dibenzyl polysulfide, a di-tert-nonyl polysulfide, a didodecyl polysulfide, a di-tert-butyl polysulfide, a dioctyl polysulfide, a diphenyl polysulfide, a dicyclohexyl polysulfide and the like are more preferable and disulfides thereof are particularly preferable.

In consideration of the volume resistivity of the lubricating oil composition, the content of the component (c) in the composition is preferably 1000 ppm by mass or less in terms of the sulfur amount in the total amount of the composition, more preferably in a range from 125 ppm by mass to 1000 ppm by mass. Further, in consideration of both the volume resistivity and the wear resistance of the lubricating oil composition, the content is particularly preferably in a range from 125 ppm by mass to 500 ppm by mass. When the content of the component (c) is equal to or more than the above lower limit, the lubricating oil composition can exhibit improved resistance to wear between metal-metal. When the content of the component (c) exceeds the above upper limit, the volume resistivity of the lubrication oil composition may be lowered.

Other Additives

The lubricating oil composition according to the exemplary embodiment may be added as necessary with other additives such as an antioxidant, a viscosity index improver, a rust inhibitor, a copper deactivator, an antifoaming agent and an ashless dispersant as long as advantages of the invention are not hampered.

Examples of the antioxidant are amine antioxidants (diphenyl amines and naphthyl amines), phenol antioxidants and sulfur antioxidants. A preferable content of the antioxidant is approximately in a range from 0.05 mass % to 7 mass %.

Examples of the viscosity index improver are polymethacrylate, a dispersed polymethacrylate, an olefin copolymer (such as an ethylene-propylene copolymer), a dispersed olefin copolymer, and a styrene copolymer (such as a styrene-diene copolymer and a styrene-isoprene copolymer). In consideration of blending effects, a preferable content of the viscosity index improver is approximately in a range from 0.5 mass % to 15 mass % of the total amount of the composition.

Examples of the rust inhibitor are a fatty acid, an alkenyl succinic half ester, a fatty acid soap, an alkyl sulfonate, a fatty acid ester of polyhydric alcohol, a fatty acid amide, an oxidized paraffin and an alkyl polyoxyethylene ether. A preferable content of the rust inhibitor is approximately in a range from 0.01 mass % to 3 mass % of the total amount of the composition.

Examples of the copper deactivator are benzotriazole, a benzotriazole derivative, triazole, a triazole derivative, imidazole and an imidazole derivative. A preferable content of the copper deactivator is approximately in a range from 0.01 mass % to 5 mass % of the total amount of the composition.

Examples of the antifoaming agent are a silicone compound and an ester compound. A preferable content of the antifoaming agent is approximately in a range from 0.01 mass % to 5 mass % of the total amount of the composition.

Examples of the ashless dispersant are a succinimide compound, a boric imide compound and an acid amide compound. A preferable content of the ashless dispersant is approximately in a range from 0.1 mass % to 20 mass % of the total amount of the composition.

EXAMPLES

Next, the invention will be further described in detail based on Examples, which by no means limit the invention. The properties (volume resistivity, resistance to wear between metal-metal, and solubility) of the lubricating oil composition (sample oil) of each of Examples were measured by the following methods.

(1) Volume Resistivity

In accordance with a method defined in JIS C2101, the volume resistivity of each sample oil was measured under test conditions such as a measurement temperature of 80 degrees C., an applied voltage of 250 V, and a measurement time of one minute. It should be noted that when a sample oil exhibits a volume resistivity of $5\times10^{10}$ Ωm or more, it is judged that the volume resistivity of the sample oil is sufficiently high.

(2) Resistance to Wear Between Metal-Metal (i) Shell Four Ball Wear Test

For evaluating resistance to wear between metal-metal, a wear track diameter was measured under test conditions such as a rotation speed of 1800 rpm, a measurement temperature of 75 degrees C., a load of 392 N, and a test time of 60 minutes in accordance with a method defined in ASTM (American Society for Testing and Materials) D4172. It should be noted that when a wear track diameter is small, it is judged that a sample oil exhibits excellent resistance to wear between metal-metal. Specifically, when a wear track diameter is equal to or smaller than 0.6 mm, a sample oil exhibits favorable resistance to wear between metal-metal.

(ii) Shell Four Ball Extreme Pressure Test

For evaluating resistance to wear between metal-metal, a load-wear index (LWI) was measured under test conditions such as a rotation speed of 1800 rpm in accordance with a method defined in ASTM D2783. It should be noted that when an LWI is large, it is judged that a sample oil exhibits excellent resistance to wear between metal-metal. Specifically, when an LWI is equal to or more than 350 N, it is judged that a sample oil exhibits favorable resistance to wear between metal-metal.

(3) Solubility

Each sample oil was left at −5 degrees C. for 10 days and then the appearance thereof was visually checked, thereby evaluating the solubility of the compound to the lubricating base oil. It should be noted that the solubility can be evaluated depending on the existence or non-existence of the opacity of a sample oil. Specifically, when a sample oil has no opacity, it is judged that the solubility of the sample oil is favorable.

Examples 1 to 11 and Comparative Examples 1 to 9

Using the following lubricating base oils, various polymer compounds and additives, lubricating oil compositions (sample oils) for a transmission were prepared in accordance with composition ratios shown in Tables 1, 2 and 3. The prepared sample oils were each evaluated by the above methods. Measurement results are shown in Tables 1, 2 and 3.

Base oil: a mixed oil provided by mixing a base oil A (a mineral oil, a kinematic viscosity at 40 degrees C.: 20 $mm^2/s$, a kinematic viscosity at 100 degrees C.: 4.2 $mm^2/s$) and a base oil B (a mineral oil, a kinematic viscosity at 40 degrees C.: 10 $mm^2/s$, a kinematic viscosity at 100 degrees C.: 2.7 $mm^2/s$) together such that the kinematic viscosity of the lubricating oil composition at 100 degrees C. becomes 5 $mm^2/s$.

Aromatic neutral phosphate: tricresyl phosphate

Alkyl phosphate amine salt: dioleyl acid phosphate amine salt

Alkyl phosphite: dioleyl hydrogen phosphite

Alkyl thiadiazole: 2,5-bis(1,1,3,3-tetramethylbutanedithio)-1,3,4-thiadiazole

Dibenzyl polysulfide: dibenzyl disulfide

Alkyl phosphate: dioleyl acid phosphate

Dialkyl zinc dithiophosphate (ZnDTP): dialkyl zinc dithiophosphate containing a primary alkyl group having 8 to 12 carbon atoms Other additives: an antioxidant, a rust inhibitor, a copper deactivator and an antifoaming agent Automatic transmission fluid (ATF): NISSAN ATF Matic Fluid J Continuously variable transmission fluid (CVTF): NISSAN CVT Fluid NS-2

TABLE 1

| | | Examples | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Composition Ratio (mass %) | Base Oil | 92.73 | 92.61 | 92.27 | 92.64 | 92.34 | 92.22 | 93.01 | 92.11 | 92.64 | 92.55 | 92.57 |
| | Polymethacrylate | 5.0 | 5.0 | 5.0 | 5.0 | 5.0 | 5.0 | 5.0 | 5.0 | 5.0 | 5.0 | 5.0 |
| | (a) Neutral Phosphorus Compound | | | | | | | | | | | |
| | Aromatic Neutral Phosphate | 0.8 | 0.8 | 0.8 | 0.8 | 0.8 | 0.8 | 0.4 | 1.3 | 0.8 | 0.8 | 0.8 |
| | (b-1) Acid Phosphate Amine Salt | | | | | | | | | | | |
| | Alkyl Phosphate Amine Salt | 0.07 | 0.15 | 0.37 | — | — | 0.62 | 0.15 | 0.15 | 0.15 | 0.15 | 0.15 |
| | (b-2) Acid Phosphite | | | | | | | | | | | |
| | Alkyl Phosphite | 0.04 | 0.08 | 0.2 | 0.2 | 0.5 | — | 0.08 | 0.08 | 0.08 | 0.08 | 0.08 |
| | (c) Sulfur Compound | | | | | | | | | | | |
| | Alkyl Thiadiazole | 0.06 | 0.06 | 0.06 | 0.06 | 0.06 | 0.06 | 0.06 | 0.06 | 0.03 | 0.12 | — |
| | Dibenzyl Polysulfide | — | — | — | — | — | — | — | — | — | — | 0.1 |
| | Other Additives | 1.3 | 1.3 | 1.3 | 1.3 | 1.3 | 1.3 | 1.3 | 1.3 | 1.3 | 1.3 | 1.3 |
| | P Amount (ppm) Amount from Component (a) | 600 | 600 | 600 | 600 | 600 | 600 | 300 | 1000 | 600 | 600 | 600 |
| | P Amount (ppm) Amount from Component (b) | 50 | 100 | 250 | 100 | 250 | 250 | 100 | 100 | 100 | 100 | 100 |
| | S Amount (ppm) | 250 | 250 | 250 | 250 | 250 | 250 | 250 | 250 | 125 | 500 | 250 |
| Properties | Volume Resistivity (Ωm) | $1.5 \times 10^{11}$ | $1.4 \times 10^{11}$ | $6.4 \times 10^{10}$ | $1.6 \times 10^{11}$ | $7.0 \times 10^{10}$ | $6.1 \times 10^{10}$ | $1.6 \times 10^{11}$ | $1.6 \times 10^{11}$ | $1.8 \times 10^{11}$ | $7.5 \times 10^{10}$ | $1.0 \times 10^{11}$ |
| | Shell Four Ball Wear Test, Wear (mm) | 0.58 | 0.56 | 0.52 | 0.58 | 0.58 | 0.50 | 0.59 | 0.51 | 0.59 | 0.52 | 0.54 |
| | Shell Four Ball Extreme Pressure Test, LWI (N) | 350 | 354 | 362 | 355 | 372 | 368 | 351 | 360 | 351 | 358 | 365 |
| | Solubility (Existence of Opacity) | No | No | No | No | No | No | No | No | No | No | No |

TABLE 2

| | | Comparative Examples | | | | |
|---|---|---|---|---|---|---|
| | | 1 | 2 | 3 | 4 | 5 |
| Composition Ratio (mass %) | Base Oil | 92.6 | 92.8 | 92.8 | 90.6 | 92.5 |
| | Polymethacrylate | 5.0 | 5.0 | 5.0 | 5.0 | 5.0 |
| | (a) Neutral Phosphorus Compound | | | | | |
| | Aromatic Neutral Phosphate | — | — | 0.8 | 3.0 | 0.8 |
| | (b-1) Acid Phosphate Amine Salt | | | | | |
| | Alkyl Phosphate Amine Salt | 1.0 | — | — | — | 0.4 |
| | (b-2) Acid Phosphite | | | | | |
| | Alkyl Phosphite | — | 0.8 | — | — | — |
| | (c) Sulfur Compound | | | | | |
| | Alkyl Thiadiazole | 0.06 | 0.06 | 0.06 | 0.06 | — |
| | Other Additives | 1.3 | 1.3 | 1.3 | 1.3 | 1.3 |
| | P Amount (ppm) Amount from Component (a) | 0 | 0 | 600 | 2250 | 600 |
| | P Amount (ppm) Amount from Component (b) | 400 | 400 | 0 | 0 | 100 |
| | S Amount (ppm) | 250 | 250 | 250 | 250 | 0 |
| Properties | Volume Resistivity (Ωm) | $3.5 \times 10^{10}$ | $4.6 \times 10^{10}$ | $1.8 \times 10^{11}$ | $1.9 \times 10^{11}$ | $1.8 \times 10^{11}$ |
| | Shell Four Ball Wear Test, Wear (mm) | 0.52 | 0.61 | 0.69 | 0.62 | 0.81 |
| | Shell Four Ball Extreme Pressure Test, LWI (N) | 340 | 321 | 328 | 354 | 333 |
| | Solubility (Existence of Opacity) | No | No | No | Yes | No |

TABLE 3

| | | Comparative Examples | | | |
|---|---|---|---|---|---|
| | | 6 | 7 | 8 | 9 |
| Composition Ratio (mass %) | Base Oil | 92.7 | 92.6 | Commercially Available ATF | Commercially Available CVTF |
| | Polymethacrylate | 5.0 | 5.0 | | |
| | (a) Neutral Phosphorus Compound | | | | |
| | Aromatic Neutral Phosphate | 0.8 | — | | |
| | (c) Sulfur Compound | | | | |
| | Alkyl Thiadiazole | 0.06 | 0.06 | | |
| | (d) Acid Phosphate | | | | |
| | Alkyl Phosphate | 0.15 | — | | |
| | (e) ZnDTP | | | | |
| | Dialkyl Zinc Dithiophosphate | — | 1.0 | | |
| | Other Additives | 1.3 | 1.3 | | |
| | P Amount (ppm) Amount from Component (a) | 600 | 0 | | |
| | Amount from Components (d)(e) | 100 | 750 | | |
| | S Amount (ppm) | 250 | 1750 | | |
| | Zn Amount (ppm) | 0 | 850 | | |
| Properties | Volume Resistivity (Ωm) | $9.5 \times 10^9$ | $2.4 \times 10^9$ | $3.2 \times 10^7$ | $2.8 \times 10^7$ |
| | Shell Four Ball Wear Test, Wear (mm) | 0.57 | 0.71 | 0.61 | 0.59 |
| | Shell Four Ball Extreme Pressure Test, LWI (N) | 341 | 354 | 290 | 328 |
| | Solubility (Existence of Opacity) | No | No | No | No |

Evaluation Results

As is apparent from the results shown in Tables 1 to 3, since the lubricating oil compositions according to the invention (Examples 1 to 11) were each provided by blending the lubricating base oil with the neutral phosphorus compound, at least one of the acid phosphate amine salt and the acid phosphite, and the sulfur compound, they were excellent both in resistance to wear between metal-metal and in electrical insulation properties.

In contrast, the lubricating oil composition of Comparative Examples 1 to 9 could not be sufficient both in resistance to wear between metal-metal and in volume resistivity. For instance, the lubricating oil compositions of Comparative Examples 1 and 2, which were not blended with the neutral phosphorus compound, were insufficient in volume resistivity. The lubricating oil composition of Comparative Example 3, which was blended with neither the acid phosphate amine salt nor the acid phosphite, was insufficient in resistance to wear between metal-metal. Further, it has been confirmed that a lubricating oil composition blended with neither the acid phosphate amine salt nor the acid phosphite is likely to have opacity as in Comparative Example 4 irrespective of an increase in the content of the neutral phosphorus compound. The lubricating oil composition of Comparative Example 5, which was not blended with the sulfur compound, was insufficient in resistance to wear between metal-metal.

The invention claimed is:

1. A process for cooling a device or lubricating a gear contained in a hybrid or electric vehicle, comprising:

contacting a device or gear with a lubricating oil composition comprising:

at least one lubricating base oil selected from the group consisting of a mineral lubricating base oil and a synthetic lubricating base oil;

(a) a neutral phosphorus compound;

(b) at least one acid phosphorus compound selected from the group consisting of di-2-ethylhexyl acid phosphate amine salt, a dilauryl acid phosphate amine salt, a dioleyl acid phosphate amine salt, a diphenyl acid phosphate amine salt, a dicresyl acid phosphate amine salt, a S-octyl thioethyl acid phosphate amine salt, a S-dodecyl thioethyl acid phosphate amine salt and an acid phosphite of formula (2):

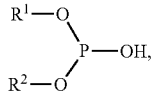

(2)

wherein $R^1$ and $R^2$ are each independently hydrogen or a hydrocarbon group comprising 8 to 30 carbon atoms, at least one of $R^1$ and $R^2$ is the hydrocarbon group comprising 8 to 30 carbon atoms, and the hydrocarbon group being at least one hydrocarbon group selected from the group consisting of an alkyl group, an alkenyl group, an aryl group, an alkylaryl group, and an arylalkyl group; and (c) a sulfur compound, wherein a content of (a) is in the range of 100 ppm to 2000 ppm by mass in terms of an amount of phosphorus in a total amount of the composition, a content of (b) is in the range of 50 ppm to 400 ppm by mass in terms of an amount of phosphorus in the total amount of the composition, a content of (c) is equal to or less than 1000 ppm by mass in terms of an amount of sulfur in the total amount of the composition, and the composition has a volume resistivity of $5\times10^{10}$ Ωm or more under a test measured at a temperature of 80° C. and an applied voltage of 250V with a measurement time of one minute in accordance with the method described in JIS C2101, and wherein the device or gear is contained in a hybrid or electric vehicle.

2. The process of claim 1, wherein a content of the component (c) is in a range from 125 to 1000 ppm by mass, based on a sulfur amount in a total amount of the composition.

3. The process of claim 1, wherein the device is at least one of a motor, a battery, an inverter, an engine, and an electric cell.

4. The process of claim 1, wherein a content of the component (a) is in a range from 200 to 1000 ppm by mass, based on a phosphorus amount in a total amount of the composition.

5. The process of claim 1, wherein a content of the component (b) is in a range from 50 to 250 ppm by mass, based on a phosphorus amount in a total amount of the composition.

6. The process of claim 1, wherein a content of the component (c) is in a range from 125 to 500 ppm by mass, based on a sulfur amount in a total amount of the composition.

7. The process of claim 4, wherein a content of the component (b) is in a range from 50 to 250 ppm by mass, based on a phosphorus amount in a total amount of the composition.

8. The process of claim 4, wherein a content of the component (c) is in a range from 125 to 500 ppm by mass, based on a sulfur amount in a total amount of the composition.

9. The process of claim 5, wherein a content of the component (c) is in a range from 125 to 500 ppm by mass, based on a sulfur amount in a total amount of the composition.

10. The process of claim 7, wherein a content of the component (c) is in a range from 125 to 500 ppm by mass, based on a sulfur amount in a total amount of the composition.

11. The process of claim 1, wherein the kinematic viscosity of the lubricating base oil is in a range from 3 $mm^2/s$ to 8 $mm^2/s$ at 100° C.

12. The process of claim 1, wherein the lubricating base oil has an aromatic content percentage, % CA, measured by a ring analysis of 3.0 or less and sulfur content less than 50 ppm.

13. The process of claim 12, wherein the lubricating base oil has a % CA of 1.0 or less and a sulfur content less than 30 ppm.

14. The process of claim 13, wherein the lubricating base oil has a % CA of 0.5 or less.

15. The process of claim 11, wherein the lubricating base oil has a viscosity index of 70 or more.

16. The process of claim 12, wherein the lubricating base oil has a viscosity index of 100 or more.

17. The process of claim 14, wherein the lubricating base oil has a viscosity index of 100 or more.

* * * * *